US011835294B2

(12) United States Patent
Kawahara et al.

(10) Patent No.: US 11,835,294 B2
(45) Date of Patent: Dec. 5, 2023

(54) HEAT TREATMENT FURNACE, HEATING DEVICE, MANUFACTURING METHOD OF WIRE ELECTRODE AND HEAT DIFFUSION TREATMENT METHOD

(71) Applicant: Sodick Co., Ltd., Kanagawa (JP)

(72) Inventors: Tetsuro Kawahara, Kanagawa (JP); Tomoaki Asaoka, Kanagawa (JP); Masaru Nakamura, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 86 days.

(21) Appl. No.: 17/160,391

(22) Filed: Jan. 28, 2021

(65) Prior Publication Data

US 2021/0239398 A1 Aug. 5, 2021

(30) Foreign Application Priority Data

Jan. 30, 2020 (JP) ..... 2020-013123

(51) Int. Cl.
*F27B 9/28* (2006.01)
*F27B 9/06* (2006.01)

(52) U.S. Cl.
CPC ..... *F27B 9/28* (2013.01); *F27B 9/062* (2013.01)

(58) Field of Classification Search
None
See application file for complete search history.

(56) References Cited

U.S. PATENT DOCUMENTS 4,437,904 A * 3/1984 MacCraven ..... C22F 1/04 148/703
5,721,414 A 2/1998 Lacourcelle
5,858,136 A 1/1999 Briffod
6,176,994 B1 1/2001 Lacourcelle
10,589,369 B2 3/2020 Kimoto et al.
2016/0368070 A1 12/2016 Liang et al.
(Continued)

FOREIGN PATENT DOCUMENTS

GB 1596989 A * 9/1981 ..... C21D 9/52
JP S564312 1/1981
(Continued)

OTHER PUBLICATIONS

English translation of JP S6156247 A (Year: 1986).*
(Continued)

*Primary Examiner* — Steven S Anderson, II
*Assistant Examiner* — Kurt J Wolford
(74) *Attorney, Agent, or Firm* — JCIPRNET

(57) ABSTRACT

The disclosure is a heat treatment furnace which heats an element wire for a wire electrode to perform a heat diffusion treatment and includes: first, second and third rotary electrodes to which a voltage is applied; a motor that rotationally drives the rotary electrodes; and a control device. The first, second and third rotary electrodes are arranged in a manner that the element wire is laid in a V-shape or an I-shape in an order of the second rotary electrode, the first rotary electrode and the third rotary electrode from the upstream side in a travel direction of the element wire. The element wire is caused to travel, a voltage is applied to the first, second and third rotary electrodes, and a current flows through and heats the element wire which travels in a first heating section and a second heating section.

6 Claims, 6 Drawing Sheets

(56) References Cited

U.S. PATENT DOCUMENTS

| | | | | |
|---|---|---|---|---|
| 2017/0014927 | A1 | 1/2017 | Tsuji et al. | |
| 2019/0360749 | A1 * | 11/2019 | Sakai | C21D 1/52 |

FOREIGN PATENT DOCUMENTS

| | | | | |
|---|---|---|---|---|
| JP | S59110516 | | 6/1984 | |
| JP | S60165367 | | 8/1985 | |
| JP | S6156247 | | 3/1986 | |
| JP | H02133129 | | 5/1990 | |
| JP | H06190635 | | 7/1994 | |
| JP | H10298669 | | 11/1998 | |
| JP | 2001335846 | | 12/2001 | |
| JP | 6124333 | | 5/2017 | |
| JP | 6584765 | | 10/2019 | |
| WO | WO-2019122252 | A1 * | 6/2019 | C21D 11/00 |
| WO | WO-2019202501 | A1 * | 10/2019 | |

OTHER PUBLICATIONS

WO-2019122252-A1 English translation (Year: 2019).*
Office Action of Japan Counterpart Application, with English translation thereof, dated Apr. 27, 2021, pp. 1-11.

* cited by examiner

HEAT TREATMENT FURNACE, HEATING DEVICE, MANUFACTURING METHOD OF WIRE ELECTRODE AND HEAT DIFFUSION TREATMENT METHOD

CROSS-REFERENCE TO RELATED APPLICATION

This application claims the priority benefit of Japan application serial no. 2020-013123, filed on Jan. 30, 2020. The entirety of the above-mentioned patent application is hereby incorporated by reference herein and made a part of this specification.

BACKGROUND

Technical Field

The disclosure relates to a heat treatment furnace and a heating device capable of performing a heat diffusion treatment in wire electrode manufacture. The disclosure also relates to a manufacturing method of a wire electrode and a heat diffusion treatment method in which a brass core and a zinc coating layer are thermally diffused and a diffusion layer is generated on the surface of a wire electrode.

Related Art

One of methods used in metal processing is wire electric discharge processing. The wire electric discharge processing is a technique in which a voltage is applied to a wire electrode which is a wire for electric discharge processing to cause the wire to continuously travel, an electric discharge is generated between the wire electrode and a processed object, the processed object is melted by the electric discharge energy, and then the processed object is cut into a desired processed shape.

The wire electrode used in wire electric discharge processing is a linear long tool electrode made of metal and having a wire diameter of 90.03 mm or more and 90.3 mm or less. In order to improve electric discharge processing characteristics of the wire electrode, a so-called composite wire electrode has been conducted conventionally which has a multilayer structure of two or more layers of a brass core and a zinc coating layer, wherein a brass core wire is subjected to zinc galvanizing and coated in the multilayer structure. The composite wire electrode is superior in achieving both heat resistance, tensile strength, and conductivity as compared with a brass wire electrode having a structure that does not have multiple layers with different properties (hereinafter referred to as single-layer wire electrode with respect to the composite wire electrode).

However, the zinc coating layer (zinc galvanizing layer) coated on the brass core wire by galvanizing is difficult to be fixed to a core wire of an element wire which is a core of the composite wire electrode. Therefore, when the diameter is reduced by drawing in wire drawing processing, the surface may be roughened and the coating layer may be partially peeled off. In particular, in the electro-galvanizing, the zinc coating layer cannot be made greatly thick, and it is not easy to reduce the diameter to 90.2 mm which is a standard wire diameter of a wire electrode.

Thus, by zinc galvanizing the brass core wire and then performing a heat diffusion treatment to form a diffusion alloy layer on the outer surface of the wire electrode, a wire electrode has been developed that is not easily broken even when drawn and has improved surface roughness.

Patent literature 1 is an invention relating to a manufacturing method of a wire electrode, and describes that an element wire having a zinc coating layer is introduced into an electric heat treatment furnace including a plurality of heaters in a heat diffusion treatment step, and then the element wire is horizontally stretched in the heat treatment furnace and made to linearly travel in the horizontal direction at a predetermined constant speed, and is exposed to a predetermined constant temperature atmosphere and continuously radiantly heated for a predetermined time until the coating layer becomes zinc-rich brass having a predetermined zinc concentration (paragraph 0052 and FIG. 3 of Patent literature 1).

Patent literature 2 is an invention relating to an electrode line for electric discharge processing, and describes a manufacturing method of an electrode line which includes a zinc plating step (first step), a heat treatment step (second step), and a wire drawing step (third step), wherein in the second step, a zinc-plated core material is passed through a high-temperature electric furnace and subjected to a heat treatment under predetermined heat treatment conditions (heat treatment temperature and heat treatment time), and further, in the high-temperature electric furnace, a β-brass layer is formed on the surface of α-brass, and subsequently, a γ-brass layer is formed on the outer layer of the β-brass layer (paragraph 0039 and FIG. 2 of Patent literature 2).

Patent literature 3 is an invention relating to a manufacturing method of an electrode line for wire electric discharge processing, and describes that by subjecting a core wire to an electric zinc plating treatment, a zinc layer and an outer copper layer are formed on the outer peripheral surface of the core wire to obtain a coated wire material, and subsequently, the coated wire material is subjected to a heat treatment in which the coated wire material is heated at 300° C. to 500° C. for 1 to 6 hours in an inert gas atmosphere (for example, in a nitrogen gas atmosphere) by using a heat treatment furnace or the like to obtain an electrode line for wire electric discharge processing (paragraphs 0013-0015 of Patent literature 3).

LITERATURE OF RELATED ART

Patent Literature

Patent literature 1: Japanese Patent No. 6124333
Patent literature 2: Japanese Patent No. 6584765
Patent literature 3: Japanese Patent Laid-Open No. H6-190635

SUMMARY

However, conventionally, in the heat diffusion treatment for forming a diffusion alloy layer on the outer surface of a wire electrode, it is necessary that the inside of an electric heat treatment furnace including a plurality of heaters and the like is heated to a high temperature of 300° C. to 500° C., and the temperature inside the furnace is maintained at the high temperature in order to heat and diffuse the core wire by placing or passing the core wire for a certain period of time. Therefore, power consumption in the heat diffusion treatment step is enormous, and accounts for 50% of the total power required for manufacturing the wire electrode. Thus, reduction of power consumption has become a major issue at a manufacturing site.

Furthermore, in the heat diffusion treatment, a method is common that causes the core wire to travel straight in the horizontal direction at a predetermined speed and gradually heats and diffuses the core wire in the heat treatment furnace, and in that case, because it is necessary to increase the total length of the heat treatment furnace in order to obtain a required heat diffusion reaction, an enlargement of the device cannot be avoided.

In view of the above problems, embodiments of the disclosure relate to power saving of a heat diffusion treatment that uses a resistance heating method, the miniaturization of a heat treatment furnace and shortening the time of the heat diffusion treatment. Other advantages of a wire electrode of the disclosure are described in each detailed description of the disclosure.

The disclosure is a heat treatment furnace, which moves an element wire having been zinc-galvanized at a predetermined speed and heats the element wire to perform a heat diffusion treatment. The heat treatment furnace includes: a first rotary electrode, a second rotary electrode and a third rotary electrode to which a voltage is applied; a motor that rotationally drives the first rotary electrode, the second rotary electrode and the third rotary electrode; and a control device. The first rotary electrode, the second rotary electrode and the third rotary electrode are arranged in a manner that the element wire is laid in a V-shape or an I-shape in an order of the second rotary electrode, the first rotary electrode and the third rotary electrode from the upstream side in a travel direction of the element wire. The motor is driven according to a command from the control device to cause the element wire to travel, a voltage is applied to the first rotary electrode, and a voltage having a sign opposite to that of the first rotary electrode is applied to the second rotary electrode and the third rotary electrode. A current flows through and heats the element wire which travels in a first heating section between the second rotary electrode and the first rotary electrode and in a second heating section between the third rotary electrode and the first rotary electrode.

Further, the disclosure is a manufacturing method of a wire electrode, in which an element wire used for a wire electrode is heated and subjected to a heat diffusion treatment. The element wire travels on a V-shaped or an I-shaped path formed by laying in an order of a second rotary electrode, a first rotary electrode and a third rotary electrode, and the element wire is heated and subjected to the heat diffusion treatment by causing a current to flow through the element wire in a first heating section between the second rotary electrode and the first rotary electrode and in a second heating section between the third rotary electrode and the first rotary electrode. In addition, the disclosure is a heat diffusion treatment method, in which an element wire used for a wire electrode is heated and subjected to a heat diffusion treatment. The element wire travels on a V-shaped or an I-shaped path formed by laying in an order of a second rotary electrode, a first rotary electrode and a third rotary electrode, and the element wire is heated and subjected to the heat diffusion treatment by causing a current to flow through the element wire in a first heating section between the second rotary electrode and the first rotary electrode and in a second heating section between the third rotary electrode and the first rotary electrode.

Here, "being arranged in a manner that the element wire is laid in a V-shape" means that when the element wire is laid in an order of a second rotary electrode 1A, a first rotary electrode 1C and a third rotary electrode 1B as shown in FIG. 5, the element wire between the second rotary electrode 1A and the first rotary electrode 1C and the element wire between the third rotary electrode 1B and the first rotary electrode 1C are separated from each other at an angle to form a V shape.

Further, "being arranged in a manner that the element wire is laid in an I-shape" means that when the element wire is laid in an order of the second rotary electrode 1A, the first rotary electrode 1C and the third rotary electrode 1B as shown in FIG. 2, the element wire between the second rotary electrode 1A and the first rotary electrode 1C and the element wire between the third rotary electrode 1B and the first rotary electrode 1C are parallel to each other to form an I shape.

According to the disclosure, when the element wire is subjected to the heat diffusion treatment, a voltage is applied to the first, second and third rotary electrodes and a current flows through the element wire, and thereby the element wire is heated utilizing the resistance of the element wire itself, and thus it is possible to significantly reduce power consumption, and further, it is possible to shorten the time of the heat diffusion treatment, when compared with the conventional electric heat treatment furnace.

Further, because the element wire is laid in a V-shape or an I-shape due to the arrangement configuration of the first, second and third rotary electrodes, it is possible to obtain a longer heating section in a smaller space, and to realize the miniaturization of the heat treatment furnace.

In the heat treatment furnace of the disclosure, a dancer roller device is arranged on a travel path of the element wire, and the control device detects the position of the dancer roller device and controls the rotation of the motor.

According to the disclosure, because the dancer roller device is arranged on the travel path of the element wire and the rotation speeds of the first, second and third rotary electrodes are changed depending on the position of the dancer roller (dancer arm), it is possible to consistently send the element wire with a constant tension (tensile force). Because the element wire, to which a constant tension is applied, reliably contacts the first, second and third rotary electrodes, it is possible to heat the element wire appropriately.

In the heat treatment furnace of the disclosure, a heat insulation cover is arranged in the first heating section and the second heating section.

According to the disclosure, because the heat insulation cover is arranged in the first heating section and the second heating section that are heating sections in which a current flows through the element wire, it is possible to suppress heat dissipation and perform the heat diffusion treatment with less power consumption.

A heating device of the disclosure includes: the heat treatment furnace of the disclosure; a delivery device for delivering the element wire to the heat treatment furnace; and a winding device for winding a heat treatment wire discharged from the heat treatment furnace.

Because the heating device of the disclosure includes the heat treatment furnace, the delivery device, and the winding device, it is possible to treat the heat diffusion treatment step from sending out the element wire to winding the heat treatment wire with one device.

In the disclosure, in the heat treatment diffusion step at the time of manufacturing the wire electrode, the miniaturization of the heat treatment furnace can be realized by significantly reducing power consumption with a resistance heating method in which a current flows through the element wire and further devising the number and arrangement of the rotary electrodes.

DESCRIPTION OF THE EMBODIMENTS

Figure 1:
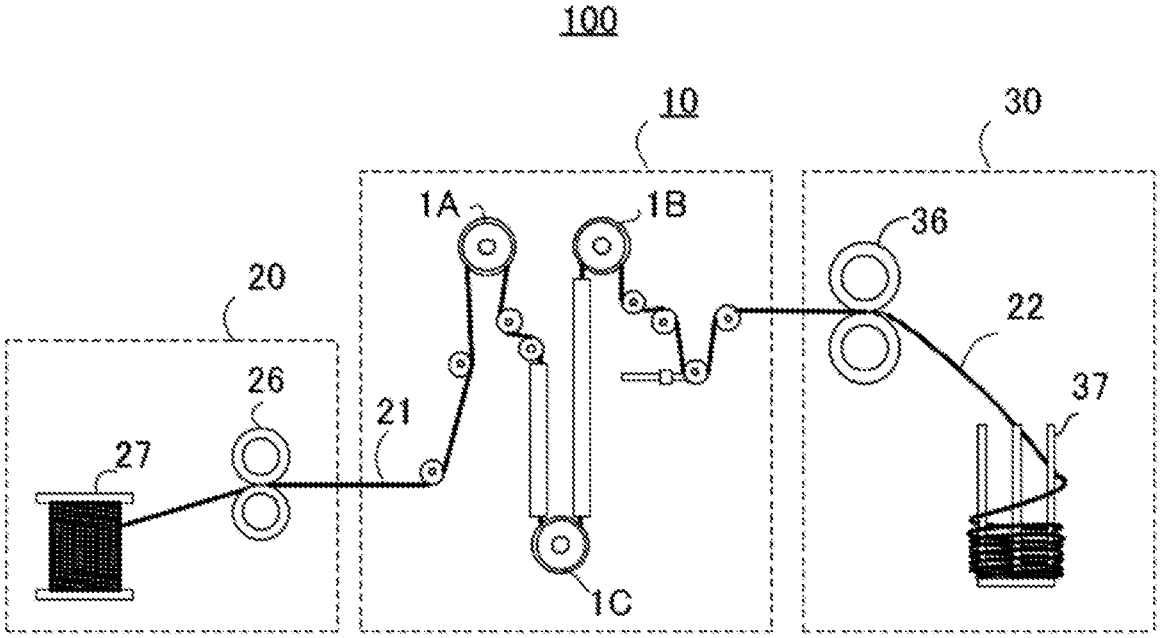
FIG. 1 is a schematic view showing an outline of a heating device 100 of the disclosure.
Figure 2:
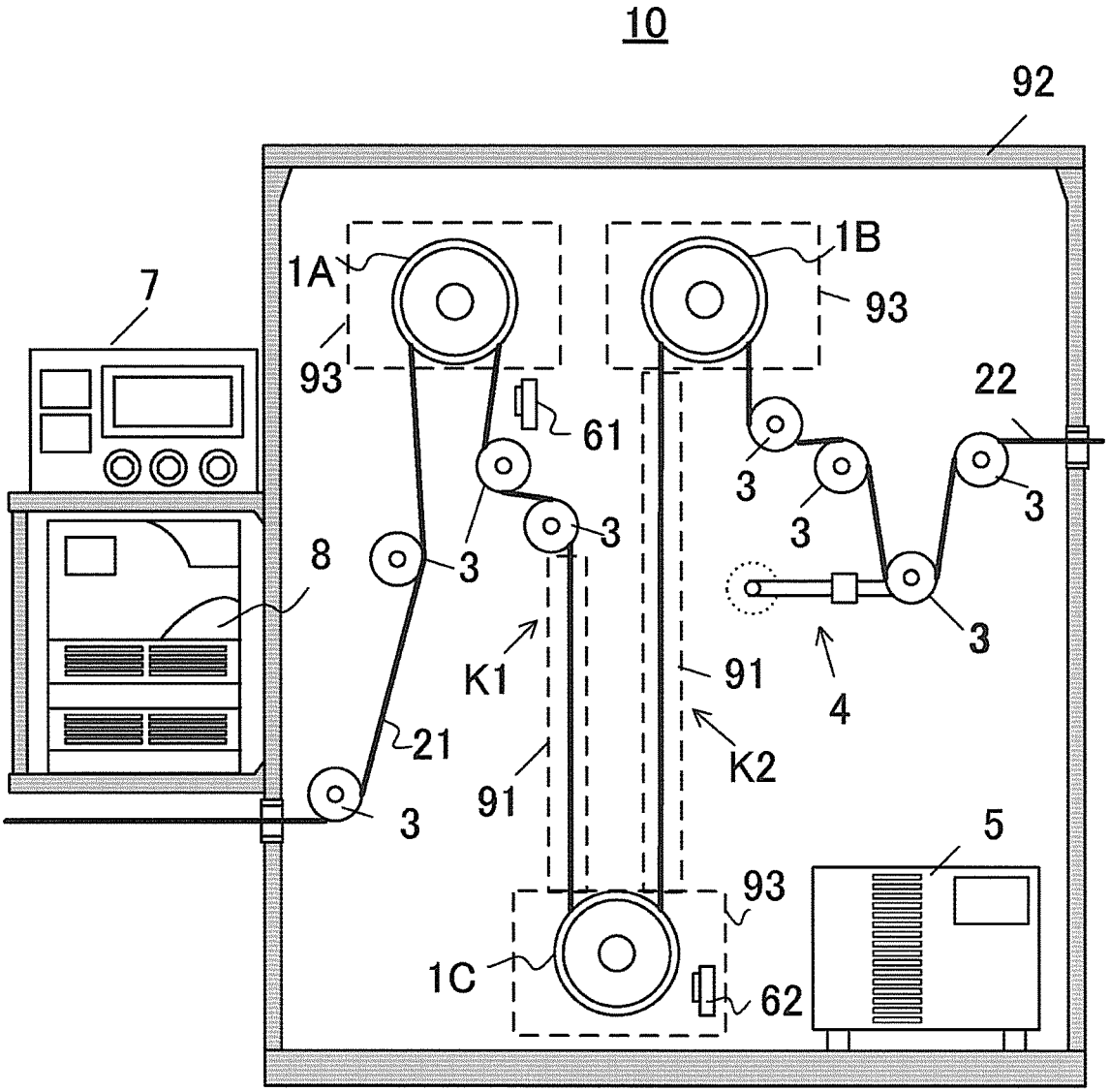
FIG. 2 is a side schematic view showing an outline of a heat treatment furnace 10 of the disclosure.
Figure 4:
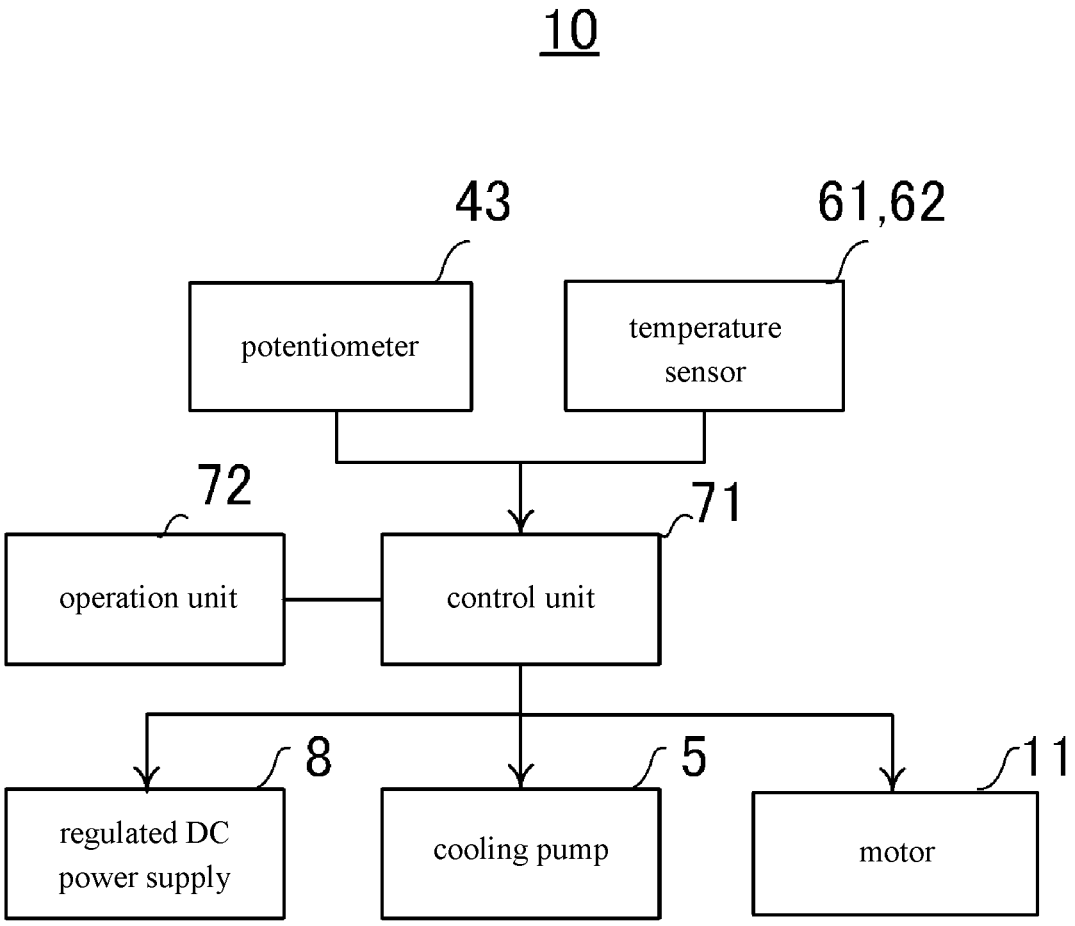
FIG. 4 is a block diagram showing the configuration of the heat treatment furnace 10 of the above embodiment.

FIG. 1 is a schematic view showing an outline of a heating device 100 of the disclosure, and FIG. 2 is a side schematic view showing an outline of a heat treatment furnace 10 of the disclosure. FIG. 4 is a block diagram showing the configuration of the heat treatment furnace 10 of the above embodiment.

The heating device 100 of the disclosure is a device for heating an element wire 21 by passing a current through the element wire 21 having been zinc-galvanized to perform a heat diffusion treatment, and includes the heat treatment furnace 10 of the disclosure, a delivery device 20, and a winding device 30.

In the heating device 100, the zinc-galvanized element wire 21 sent from the delivery device 20 is introduced into the heat treatment furnace 10 and is caused to travel at a predetermined travel speed, and a heat diffusion treatment is performed on the element wire 21 by a resistance heating method. After that, the element wire 21 is wound around the winding device 30 as a heat treatment wire 22.

The heat treatment furnace 10 is a heat treatment furnace for applying a voltage between electrodes to heat the element wire 21, and includes: a rotary electrode 1A (second rotary electrode); a rotary electrode 1B (third rotary electrode); a rotary electrode 1C (first rotary electrode); a motor 11 for rotating the rotary electrode; a plurality of rollers 3, 3 . . . for transporting the element wire 21; a dancer roller device 4; a cooling pump 5; a temperature sensor 61 that detects the temperature of the element wire 21; a temperature sensor 62 that detects the temperature of the rotary electrode; a control device 7; a regulated DC power supply 8; heat insulation covers 91, 91 that cover heating sections; cooling covers 93 that cover the rotary electrodes 1A, 1B and 1C; and a housing 92 for arranging various members.

Figure 5:
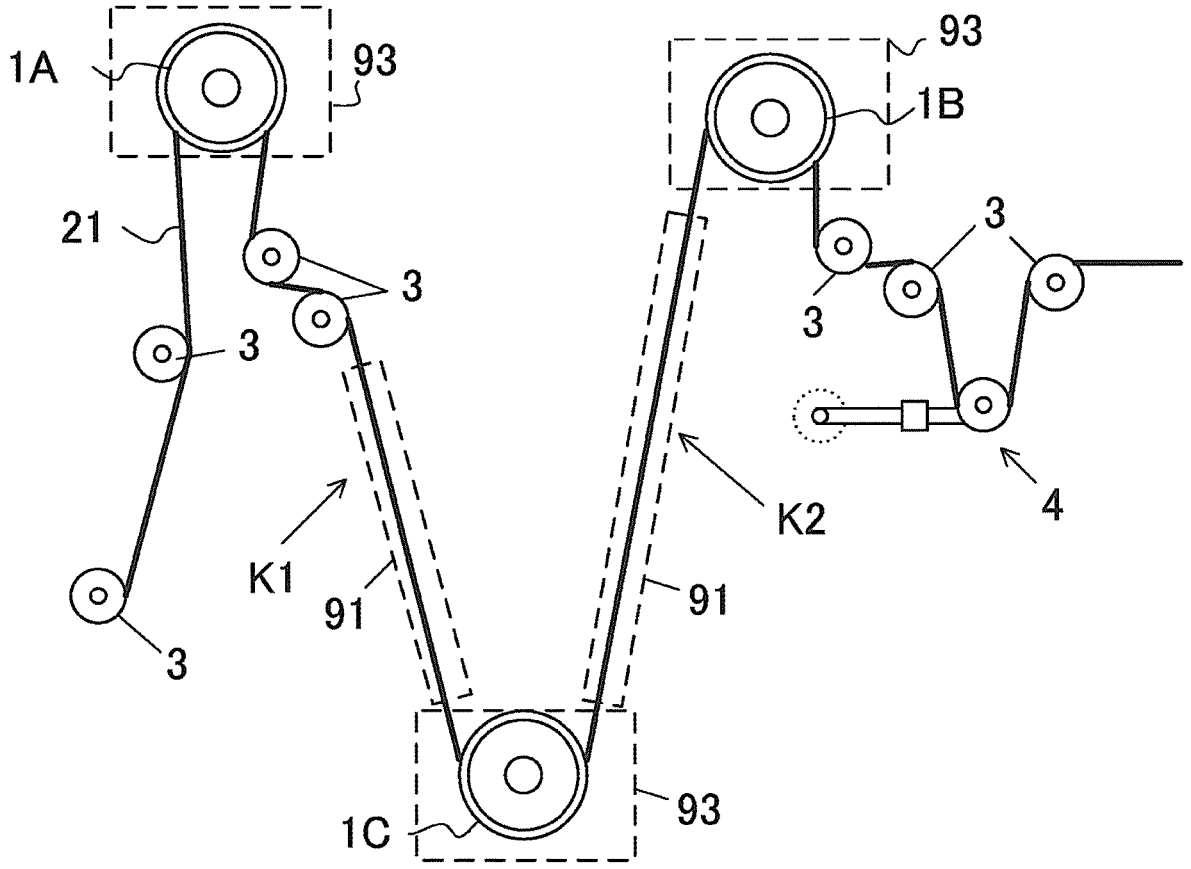
FIG. 5 is a side schematic view showing another arrangement configuration of rotary electrodes 1A, 1B and 1C of the above embodiment.

FIG. 5 is a side schematic view showing another arrangement configuration of the rotary electrodes 1A, 1B and 1C of the above embodiment.

The rotary electrodes 1A, 1B and 1C are columnar energizing rollers, the rotary electrodes 1A and 1B are arranged on the upper part inside the housing 92, and the rotary electrode 1C is arranged on the lower part inside the housing 92 between the rotary electrode 1A and the rotary electrode 1B. The peripheries of the rotary electrodes 1A, 1B and 1C are respectively covered with the cooling cover 93.

The element wire 21 is wound around the outer peripheral surfaces of the rotary electrodes 1A, 1B and 1C, and is stretched therebetween. The rotary electrodes 1A, 1B and 1C are driven to rotate by the motors 11 respectively arranged on the rotary electrodes 1A, 1B and 1C, and the element wire 21 travels in the heat treatment furnace 10 at a predetermined speed due to the rotation of the rotary electrodes 1A, 1B and 1C. Specifically, the element wire 21 is inserted from a carry-in port arranged in the housing 92 and travels upward via the roller 3, and then changes the travel direction by the rotation of the rotary electrode 1A to travel downward. After that, by the rotation of the rotary electrode 1C, the element wire 21 travels upward, and then the element wire 21 is wound around the rotary electrode 1B and discharged from a carry-out port.

As for the arrangement of the rotary electrodes 1A, 1B and 1C, when the element wire is laid in an order of the rotary electrode 1A, the rotary electrode 1C and the rotary electrode 1B, the element wire between the rotary electrode 1A and the rotary electrode 1C and the element wire between the rotary electrode 1B and the rotary electrode 1C may be parallel to each other to form an I shape as shown in FIG. 2, or may be separated from each other at an angle to form a V shape as shown in FIG. 5.

A negative voltage is applied to the rotary electrodes 1A and 1B by the regulated DC power supply 8, and a positive voltage is applied to the rotary electrode 1C. Therefore, a current flows through the element wire 21 stretched over a first heating section K1 between the rotary electrode 1A and the rotary electrode 1C and a second heating section K2 between the rotary electrode 1C and the rotary electrode 1B, and then the element wire 21 generates heat due to the resistance of the element wire 21 itself. Specifically, a current flows from the rotary electrode 1C to the rotary electrode 1A through the element wire 21, and similarly flows from the rotary electrode 1C to the rotary electrode 1B through the element wire 21. Along with the current, heat diffusion occurs on the surface of the element wire 21, and a high-quality diffusion layer is formed. The element wire 21 is heated in the first heating section K1 and further heated in the second heating section K2, and thereby the diffusion treatment proceeds rapidly, the diffusion layer on the outer surface of the element wire 21 becomes zinc-rich brass and is discharged to the outside as the heat treatment wire 22.

Here, a negative voltage is applied to the rotary electrodes 1A and 1B, and a positive voltage is applied to the rotary electrode 1C, but a positive voltage may be applied to the rotary electrodes 1A and 1B, and a negative voltage may be applied to the rotary electrode 1C.

The motor 11 is a member arranged respectively for rotating the rotary electrodes 1A, 1B and 1C, and specifically, a servomotor is used. The motor 11 controls the rotation of the rotary electrodes 1A, 1B and 1C according to a command signal from the control device 7.

The rollers 3, 3 . . . are arranged in the housing 92 for transporting the element wire 21, and are arranged at intervals in a manner of not loosening the element wire 21 so that the element wire 21 travels smoothly.

Figure 3:
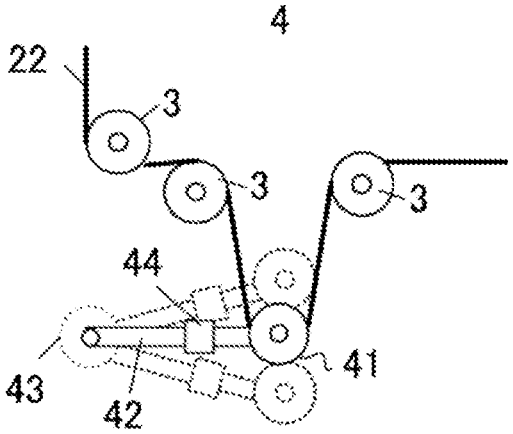
FIG. 3 is side schematic view showing an outline of a dancer roller device 4 of the above embodiment.

FIG. 3 is a side schematic view showing an outline of the dancer roller device 4 of the above embodiment.

The dancer roller device 4 is a member for maintaining a state in which a constant tension is applied to the element wire 21, and includes: a dancer roller 41 for winding the element wire 21; a dancer arm 42 that pivotally supports the dancer roller 41 at the front end; a potentiometer 43 attached to a rotation axis of the dancer arm 42 and detecting the angle of the dancer arm 42; and a dancer weight 44 for imparting tension. By adjusting the size and the position of the dancer weight 44, the tension imparted to the element wire 21 is adjusted.

The cooling pump 5 is a cooling device for cooling the rotary electrodes 1A, 1B and 1C. A pipeline for circulating a liquid cooling medium is attached to the cooling cover 93, the cooling medium in the pipeline is circulated by the cooling pump 5, and the rotary electrodes 1A, 1B and 1C in the cooling cover 93 are forcibly cooled.

The temperature sensor 61 is a detector that detects the temperature of the element wire 21. For example, an infrared sensor that is a non-contact temperature sensor is used as the temperature sensor 61. The temperature sensor 61 is arranged in the vicinity of the travel path of the element wire 21 and in the vicinity of the first heating section K1 or the second heating section K2.

The temperature sensor 62 is a detector that detects the temperature of the rotary electrodes 1A, 1B and 1C, particularly the temperature of a rotary connector attached to the rotary electrodes 1A, 1B and 1C. For example, an infrared sensor that is a non-contact temperature sensor is used as the temperature sensor 62. The temperature sensor 62 may be attached to all of the rotary electrodes 1A, 1B and 1C, or may be attached only to the rotary electrode 1B having a high load.

The control device 7 is a device that controls the entire heating device 100, and includes a control unit 71 and an operation unit 72.

The control unit 71 controls the entire heating device 100. For example, the control unit 71 controls the drive of the motor 11, controls an application voltage applied to the rotary electrodes 1A, 1B and 1C, and detects an abnormality by the temperature sensors 61 and 62.

As for the drive control of the motor 11, the control unit 71 detects the angle of the dancer arm 42 by the potentiometer 43 attached to the dancer arm 42, gives a command to the motor 11 according to the value of the angle, and controls the rotation speeds of the rotary electrodes 1A, 1B and 1C. Specifically, when the dancer arm 42 is in a horizontal equilibrium position, the rotation speeds of the rotary electrodes 1A, 1B and 1C are maintained as they are, and when the dancer arm 42 moves upward, the rotation speeds of the rotary electrodes 1A, 1B and 1C are gradually reduced. Further, when the dancer arm 42 moves downward, the rotation speeds of the rotary electrodes 1A, 1B and 1C are gradually accelerated.

In this way, because the rotation speeds of the rotary electrodes 1A, 1B and 1C are changed depending on the position of the dancer arm 42, it is possible to consistently send the element wire 21 with a constant tension.

Further, when the temperature of the element wire 21 or the temperature of the rotary electrodes 1A, 1B and 1C detected by the temperature sensors 61 and 62 is an abnormal value, the control unit 71 stops applying the voltage to the rotary electrodes 1A, 1B and 1C.

The operation unit 72 makes various settings for the heating device 100, such as a setting of the value of the application voltage, and is preferably a touch panel integrated with a display unit for example. In addition, the operation unit 72 is not limited to the touch panel, and may be equipped with a display unit and use an input device such as a mouse, a joystick, a touch pen and the like, or a command input device such as a keyboard and the like.

The delivery device 20 is a device that drives a roller 26 from a payoff reel 27 around which the zinc-galvanized element wire 21 is wound and carries the element wire 21 to the heat treatment furnace 10.

The winding device 30 is a device that winds the heat treatment wire 22 discharged from the heat treatment furnace 10 after the heat diffusion treatment is completed onto a spool 37 by driving the roller 36.

(Flow of Manufacturing Method of Wire Electrode)

Figure 6:
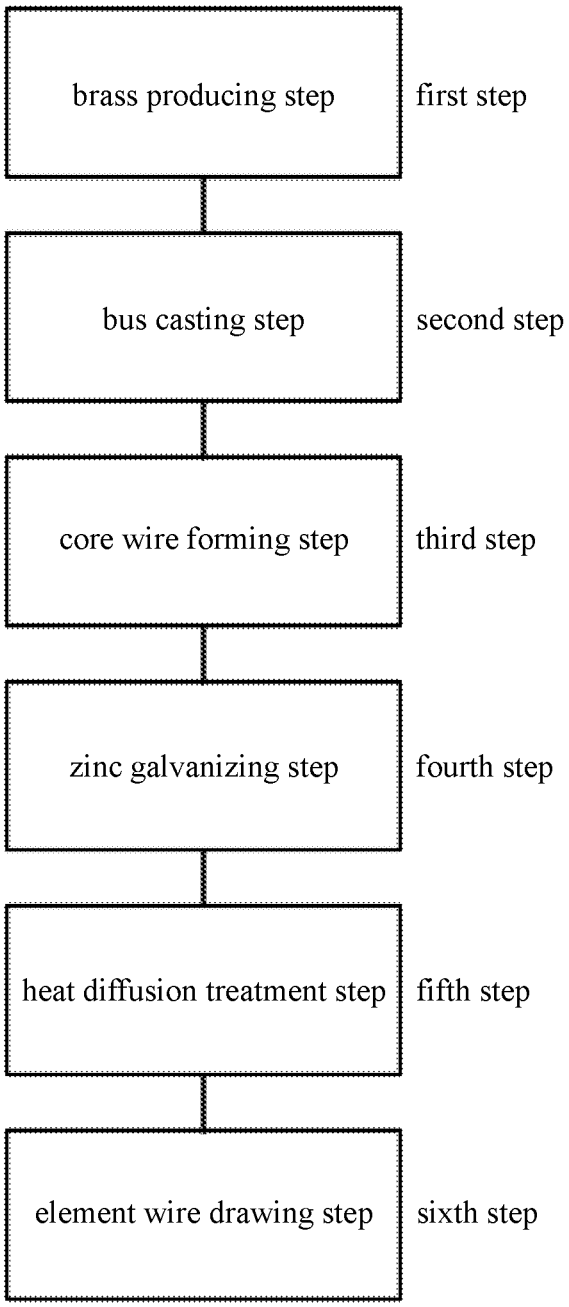
FIG. 6 is a flowchart showing a process in a manufacturing method of a wire electrode of the above embodiment.

FIG. 6 is a flowchart showing a process of the embodiment in the manufacturing method of the wire electrode. Hereinafter, specifically, a preferred embodiment of the disclosure is described by taking a process of manufacturing a brass composite wire electrode as an example, the brass composite wire electrode having a wire diameter of 90.2 mm and having a core made of brass which is composed of 65% by weight of copper and 35% by weight of zinc and a surface layer of a diffusion layer.

A first step in the process of manufacturing the wire electrode is a brass producing step in which raw materials of copper and zinc are put into a melting furnace at a predetermined ratio to be melted and mixed in order to produce a brass bus. Specifically, in order that the concentration of copper or zinc put into the melting furnace is measured and the mixing ratio of molten copper and zinc finally becomes a desired weight ratio in the core of the wire electrode, a copper plate or copper ingot and zinc powder are selectively put into the melting furnace. In the example, the weight ratio of copper to zinc is adjusted to 65/35.

A second step is a bus casting step for casting a bus. The bus is generated by continuously pouring the brass that has been mixed and melted at a desired mixing ratio in a linear manner and cooling the brass. The wire diameter of the bus is set to a size as close as possible to the wire diameter of a core wire in a subsequent zinc galvanizing step within a range in which the bus can be formed by casting.

A third step is a core wire forming step in which the bus is sequentially passed through a wire drawing die and gradually reduced in diameter by wire drawing processing to form a core wire used in a zinc galvanizing step. Because the bus to be casted has bamboo-like knots and small irregularities on the surface that are generated during manufacturing, the bus is gradually reduced in diameter and the wire diameter of the formed core wire is made constant at the same time by at least two times of wire drawing processing.

A fourth step is a zinc galvanizing step in which the core wire obtained in the core wire forming step is zinc-galvanized by an electro-galvanizing method. In the zinc galvanizing step, the core wire is stretched with a predetermined constant tension across a galvanizing bathtub, and the core wire is caused to travel at a constant travel speed by detecting the travel speed and adjusting the winding speed. The surface coating of the core wire is removed in an alkaline electrolytic linear bathtub, alkaline cleaning liquid remaining on the surface is washed away by a water cleaning device, and then the core wire is introduced into an acidic electro-galvanizing bathtub. The zinc-galvanized surface of the element wire led out from the galvanizing bathtub is sufficiently dried by a warm air heater, and then the element wire is wound on the spool by the winding device.

A fifth step is a heat diffusion treatment step in which the element wire having been zinc-galvanized with the electro-galvanizing method is continuously heated and diffused by the heating device 100 of the disclosure. Specifically, the element wire 21 having the zinc coating layer formed by electro-galvanizing is wound around the payoff reel 27, drives the roller 26, leaves the delivery device 20, and then is inserted to the heat treatment furnace 10 from the carry-in port arranged in the housing 92 of the heat treatment furnace 10. The element wire 21 passes through the first heating section K1 from the rotary electrode 1A to the rotary electrode 1C by the rotation of the rotary electrodes 1A, 1B and 1C, and then passes through the second heating section K2 from the rotary electrode 1C to the rotary electrode 1B. When the element wire 21 is traveling, a voltage is applied to the rotary electrodes 1A, 1B and 1C, a current flows through the element wire 21 in the first heating section K1 and the second heating section K2, and heat diffusion occurs and the diffusion layer is formed on the surface of the element wire 21. The element wire 21 is heated in the first heating section K1 and further heated in the second heating section K2, and thereby the diffusion treatment proceeds rapidly, the diffusion layer on the outer surface of the element wire 21 becomes zinc-rich brass and is discharged to the outside as the heat treatment wire 22.

When the entire area of the zinc coating layer, in other words, the entire outer peripheral surface uniformly becomes zinc-rich brass, the element wire 21 is sequentially led out to the outside of the heat treatment furnace 10. Then, the element wire 21 led out from the heat treatment furnace 10 is exposed to air at room temperature to be cooled naturally, and thereafter, the diffusion is stopped and the coating layer is fixed.

The heat treatment wire 22 discharged from the heat treatment furnace 10 after the heat diffusion treatment is completed is wound on the spool 37 by the roller 36 of the winding device 30.

A sixth step is an element wire drawing step in which the element wire is passed through the wire drawing die to generate a wire electrode having an arbitrary desired wire diameter. A brass composite wire electrode line can be manufactured.

The heat treatment furnace, the heating device, the manufacturing method of the wire electrode and the heat diffusion treatment method of the disclosure described above should not be limited to specific embodiments, and can be modified and carried out within a range that does not deviate from technical ideas of the disclosure.

INDUSTRIAL APPLICABILITY

The disclosure can be used in the technical field of metal processing. In particular, the disclosure is applied to a wire-cut for cutting metal with high precision to manufacture dies or parts. The disclosure provides an improved tool electrode having excellent processing precision and improved processing speed in a wire-cut at a lower cost. The disclosure contributes to the development of the technical field of metal processing.

What is claimed is:

1. A heat treatment furnace, which moves an element wire having been zinc-galvanized at a predetermined speed and heats the element wire to perform a heat diffusion treatment, comprising:

a first rotary electrode, a second rotary electrode and a third rotary electrode to which a voltage is applied; a motor that rotationally drives the first rotary electrode, the second rotary electrode and the third rotary electrode; and a control device;

wherein the first rotary electrode, the second rotary electrode and the third rotary electrode are arranged in a manner that the element wire is laid in a V-shape or an I-shape in an order of the second rotary electrode, the first rotary electrode and the third rotary electrode from the upstream side in a travel direction of the element wire;

wherein the motor is driven according to a command from the control device to cause the element wire to travel, a voltage is applied to the first rotary electrode, and a voltage having a sign opposite to that of the first rotary electrode is applied to the second rotary electrode and the third rotary electrode; and wherein a current flows through and heats the element wire which travels in a first heating section between the second rotary electrode and the first rotary electrode and in a second heating section between the third rotary electrode and the first rotary electrode, wherein the heat treatment furnace further comprises cooling covers arranged on peripheries of the first rotary electrode, the second rotary electrode and the third rotary electrode, respectively, wherein each of the cooling covers comprises a pipeline for circulating a cooling medium, the control device circulating the cooling medium in the pipeline by a cooling pump and cooling the first rotary electrode, the second rotary electrode and the third rotary electrode and during cooling medium circulation, the heat treatment furnace is configured to not directly cool the element wire, wherein the heat treatment furnace further comprises a first temperature sensor and a second temperature sensor, the first temperature sensor being arranged in a vicinity of the first heating section or the second heating section of a travel path of the element wire and detecting a temperature of the element wire, the second temperature sensor being attached to the first rotary electrode, the second rotary electrode or the third rotary electrode and detects a temperature of the first rotary electrode, the second rotary electrode or the third rotary electrode, wherein the control device controls an application voltage applied to the first rotary electrode, the second rotary electrode, and the third rotary electrode by the temperatures detected by the first temperature sensor and the second temperature sensor.

2. The heat treatment furnace according to claim 1, wherein a dancer roller device is arranged on the travel path of the element wire, and the control device detects the position of the dancer roller device and controls the rotation of the motor.

3. The heat treatment furnace according to claim 1, wherein a heat insulation cover is arranged in the first heating section and the second heating section.

4. A heating device, comprising: the heat treatment furnace according to claim 1, a delivery device for delivering the element wire to the heat treatment furnace, and a winding device for winding a heat treatment wire discharged from the heat treatment furnace.

5. A manufacturing method of a wire electrode, in which an element wire used for a wire electrode is heated and subjected to a heat diffusion treatment, wherein the element wire travels on a V-shaped or an I-shaped path formed by laying in an order of a second rotary electrode, a first rotary electrode and a third rotary electrode, and the element wire is heated and subjected to the heat diffusion treatment by causing a current to flow through the element wire in a first heating section between the second rotary electrode and the first rotary electrode and in a second heating section between the third rotary electrode and the first rotary electrode while cooling the first rotary electrode, the second rotary electrode and the third rotary electrode and not direct cooling the element wire, wherein the first rotary electrode, the second rotary electrode and the third rotary electrode are cooled by cooling covers arranged on peripheries of the first rotary electrode, the second rotary electrode and the third rotary electrode, respectively, wherein each of the cooling covers comprises a pipeline for circulating a cooling medium, the control device circulating the cooling medium in the pipeline by a cooling pump and cooling the first rotary electrode, the second rotary electrode and the third rotary electrode, and wherein a temperature of the element wire and a temperature of the first rotary electrode, the second rotary electrode or the third rotary electrode are detected by a first temperature sensor and a second temperature sensor, and an application voltage applied to the first rotary electrode, the second rotary electrode, and the third rotary electrode is controlled.

6. A heat diffusion treatment method, in which an element wire used for a wire electrode is heated and subjected to a heat diffusion treatment, wherein the element wire travels on a V-shaped or an I-shaped path formed by laying in an order of a second rotary electrode, a first rotary electrode and a third rotary electrode, and the element wire is heated and subjected to the heat diffusion treatment by causing a current to flow through the element wire in a first heating section between the second rotary electrode and the first rotary electrode and in a second heating section between the third rotary electrode and the first rotary electrode while cooling the first rotary electrode, the second rotary electrode and the third rotary electrode and not direct cooling the element wire, wherein the first rotary electrode, the second rotary electrode and the third rotary electrode are cooled by cooling covers arranged on peripheries of the first rotary electrode, the second rotary electrode and the third rotary electrode, respectively, wherein each of the cooling covers comprises a pipeline for circulating a cooling medium, the control device circulating the cooling medium in the pipeline by a cooling pump and cooling the first rotary electrode, the second rotary electrode and the third rotary electrode, and wherein a temperature of the element wire and a temperature of the first rotary electrode, the second rotary electrode or the third rotary electrode are detected by a first temperature sensor and a second temperature sensor, and an application voltage applied to the first rotary electrode, the second rotary electrode, and the third rotary electrode is controlled.

* * * * *